US008729374B2

(12) United States Patent
Haupt et al.

(10) Patent No.: US 8,729,374 B2
(45) Date of Patent: May 20, 2014

(54) METHOD AND APPARATUS FOR CONVERTING A SPOKEN VOICE TO A SINGING VOICE SUNG IN THE MANNER OF A TARGET SINGER

(75) Inventors: Marcus Haupt, Kinnelon, NJ (US); Suman Venkatesh Ravuri, Berkeley, CA (US); Adam B. Kling, West Orange, NJ (US)

(73) Assignee: Howling Technology, Upper Montclair, NJ (US)

( * ) Notice: Subject to any disclaimer, the term of this patent is extended or adjusted under 35 U.S.C. 154(b) by 375 days.

(21) Appl. No.: 13/188,622

(22) Filed: Jul. 22, 2011

(65) Prior Publication Data

US 2013/0019738 A1 Jan. 24, 2013

(51) Int. Cl.
*G10H 1/36* (2006.01)
*G10H 7/00* (2006.01)

(52) U.S. Cl.
USPC ..... 84/610; 84/634; 434/307 A

(58) Field of Classification Search
USPC ..... 84/622, 609, 610, 634; 434/307 A
See application file for complete search history.

(56) References Cited

U.S. PATENT DOCUMENTS 5,621,182 A * 4/1997 Matsumoto ..... 84/610
5,750,912 A * 5/1998 Matsumoto ..... 84/609
5,857,171 A * 1/1999 Kageyama et al. ..... 704/268
5,889,223 A * 3/1999 Matsumoto ..... 84/609
5,955,693 A * 9/1999 Kageyama ..... 84/610
6,148,086 A * 11/2000 Ciullo et al. ..... 381/106
6,326,536 B1 * 12/2001 Wang ..... 84/477 R
7,135,636 B2 * 11/2006 Kemmochi et al. ..... 84/622
7,464,034 B2 * 12/2008 Kawashima et al. ..... 704/266
2009/0317783 A1 * 12/2009 Noguchi ..... 434/307 A

OTHER PUBLICATIONS

Hejna, D., et al. "The SOLAFS Time-Scale Modification Algorithm", 1991, Cambridge, MA.
Dolson, M., "The Phase Vocoder: A Tutorial", Computer Music Journal, 1986, pp. 14-27, vol. 10, No. 4, The MIT Press.
Laroche, J., et al., "New Phase-Vocoder Techniques for Pitch-Shifting, Harmonizing and Other Exotic Effects", IEEE Workshop on Applications of Signal Processing to Audio and Acoustics, 1999, pp. 17-20, New Paltz, New York.
Kawahara, H., et al., "Restructuring speech representations using STRAIGHT-TEMPO: Possible role of a repetitive structure in sounds", ATR Human Information Processing Research Laboratories, Japan.
Tremain, T. E., "The Government Standard Linear Predictive Coding Algorithm: LPC-10", Speech Technology, 1982, Washington, D.C.

(Continued)

*Primary Examiner* — Jeffrey Donels
(74) *Attorney, Agent, or Firm* — Fleit Gibbons Gutman Bongini & Bianco PL; Martin Fleit; Paul D. Bianco

(57) ABSTRACT

Method and apparatus for producing a record of a person's voice that stores a recording of an artist singing a song, stores a selected sequences of sounds of a person correlated with the words being sung in the song, processes the selected stored sounds so that the person's voice sounds as if the person were singing the song with the same pitch and timing as the artist singing the stored song, combines the processed selected stored sounds with the instrumental track of the song; and stores the combined processed selected stored sounds with the instrumental track of the song.

16 Claims, 11 Drawing Sheets

(56) References Cited

OTHER PUBLICATIONS

Sondhi, M.M., "New Methods of Pitch Extraction", IEEE Transactions on Audio and Electroacoustics,1968, vol. AU-16, Cambridge, Mass.

Serra, X. et al., "Spectral Modeling Synthesis: A Sound Analysis/Synthesis System based on a Deterministic plus Stochastic Decomposition", Computer Music Journal, 1990, pp. 12-24, vol. 14, Issue 4, Massachusetts Institute of Technology.

Cho, Y.D., "Pitch Estimations Using Spectral Covariance Method for Low-Delay MBE Vocoder", IEEE, 1997, Korea.

* cited by examiner

Above: Pitch of Singer

Above: Pitch transposed onto speaker

METHOD AND APPARATUS FOR CONVERTING A SPOKEN VOICE TO A SINGING VOICE SUNG IN THE MANNER OF A TARGET SINGER

BACKGROUND OF INVENTION

1. Field of the Invention

A method and apparatus for converting spoken context-independent triphones of one speaker into a singing voice sung in the manner of a target singer and more particularly for performing singing voice synthesis from spoken speech.

2. Prior Art

Many of the components of speech systems are known in the art. Pitch detection (also called pitch estimation) can be done through a number of methods. General methods include modified autocorrelation (M. M. Sondhi, "New Methods of Pitch Extraction". IEEE Trans. Audio and Electroacoustics, Vol. AU-16, No. 2, pp. 262-266, June 1968.), spectral methods (Yong Duk Cho; Hong Kook Kim; Moo Young Kim; Sang Ryong Kim, "Pitch Estimation Using Spectral Covariance Method for Low-Delay MBEvocoder", Speech Coding For Telecommunications Proceeding, 1997, 1997 IEEE Workshop, Volume, Issue, 7-10 Sep. 1997 Page(s): 21-22.), wavelet methods (Hideki Kawahara, Ikuyo Masuda-Katsuse, Alain de Cheveigne, "Restructuring speech representations using STRAIGHT-TEMPO: Possible role of a repetitive structure in sounds", ATR-Human Information Processing Research Laboratories (Technical Report). 1997).

Time-scaling of voice is also a product that has been well-described in the art. There are two general approaches to performing time-scaling. One is time-domain scaling. In this procedure, a signal is taken and autocorrelation is performed to determine local peaks. The signal is split into frames according to the peaks outputted by the autocorrelation method and these frames are duplicated or removed depending on the type of scaling involved. One such implementation of this idea is the SOLAFS algorithm (Don Hejna, Bruce Musicus, "The SOLAFS time-scale modification algorithm", BBN, July 1991.).

Another method of time-scaling is through a phase vocoder. A vocoder takes a signal and performs a windowed Fourier transform, creating a spectrogram and phase information. In time-scaling algorithm, windowed sections of the Fourier transform are either duplicated or removed depending on the type of scaling. The implementations and algorithms are described in (Mark Dolson, "The phase vocoder: A tutorial," Computer Music Journal, vol. 10, no. 4, pp. 14-27, 1986.) and (Jean Laroche, Mark Dolson, "New Phase Vocoder Technique for Pitch-Shifting, Harmonizing and Other Exotic Effects". IEEE Workshop on Applications of Signal Processing to Audio and Acoustics. Mohonk, New Paltz, N.Y. 1999.).

Voice analysis and synthesis is a method of decomposing speech into representative components (in the analysis stage) and manipulating those representative components to create new sounds (synthesis stage). In particular, this process uses a special type of voice analysis/synthesis tool on the source-filter model, which breaks down speech into an excitation noise (produced by vocal folds) and a filter (produced by the vocal tract). Examples and descriptions of voice analysis-synthesis tools can be found in (Thomas E. Tremain, "The Government Standard Linear Predictive Coding Algorithm: LPC-10", Speech Technology Magazine, April 1982, p. 40-49.), (Xavier Serra, "Spectral Modeling Synthesis: A Sound Analysis/Synthesis System based on a Deterministic plus Stochastic Decomposition", Computer Music Journal, 14(4):12-24, 1990.), (Mark Dolson, "The phase vocoder: A tutorial," Computer Music Journal, vol. 10, no. 4, pp. 14-27, 1986.).

The closest known prior art to the present invention is the singing voice synthesis method and apparatus described in U.S. Pat. No. 7,135,636, which produces a singing voice from a generalized phoneme database. The purpose of the method and apparatus of the patent was to create an idealized singer that could sing given a note, lyrics, and a phoneme database. However, the ultimate characteristic of maintaining the identity of the original speaker was not intended according to the method and apparatus of the patent. A principal drawback of the method and apparatus of the patent is the inability to achieve the singing voice of the singer but sung in the manner of a target singer.

SUMMARY OF INVENTION

The method and apparatus of the present invention transforms spoken voice into singing voice. A user prepares by speaking sounds needed to make up the different parts of the words of a song lyrics. Sounds which the user has already used for prior songs need not be respoken, as the method and apparatus includes the ability to reuse sounds from other songs the user has produced. The method and apparatus includes an analog-to-digital converter (ADC) configured to produce an internal format as described in detail in the following detailed description of a preferred embodiment of the invention. The method and apparatus configures and operates the ADC to record samples of the user speaking the sounds needed to make up the lyrics of a song, after which the processing phase causes the user's voice to sound as if the user were singing the song with the same pitch and timing as the original artist. The synthetic vocal track is then mixed with the instrumental recording to produce a track which sounds as if the user has replaced the original artist. The method and apparatus includes a digital-to-analog converter (DAC) which can replay the final mixed output as audio for the user to enjoy. The method and apparatus retains the final mixed track for later replay, in a form readily converted to media such as that used for an audio Compact Disc (CD).

The method and apparatus is implemented using a standard PC, with a sound card that includes the ADC and the DAC and using a stored-program (a computer readable medium containing instruction to carry our the method of the invention to perform the sequencing of the steps needed for the PC to perform the intended processing. These steps include transferring sequences of sounds into internal storage, processing those stored sounds to achieve the intended effect, and replaying stored processed sounds for the user's appreciation. The apparatus would also include a standard CD/ROM drive to read in original soundtrack recordings and to produce CD recordings of the processed user results.

A number of processes are carried out by to prepare the apparatus for use. The provider of the program will have performed many of these steps in advance to prepare a programming package which prepares a PC or other such computing apparatus to perform its intended use. One step in preparation concerns simply copying the entire track library record from a master copy onto the apparatus. Other steps will become apparent from the following detailed description of the method and apparatus of the present invention taken in conjunction with the appended drawings.

BRIEF DESCRIPTION OF THE DRAWINGS

FIG. 2 is a block diagram representation of the elements in a speaker database. while

DETAILED DESCRIPTION OF PREFERRED EMBODIMENTS

Figure 1:
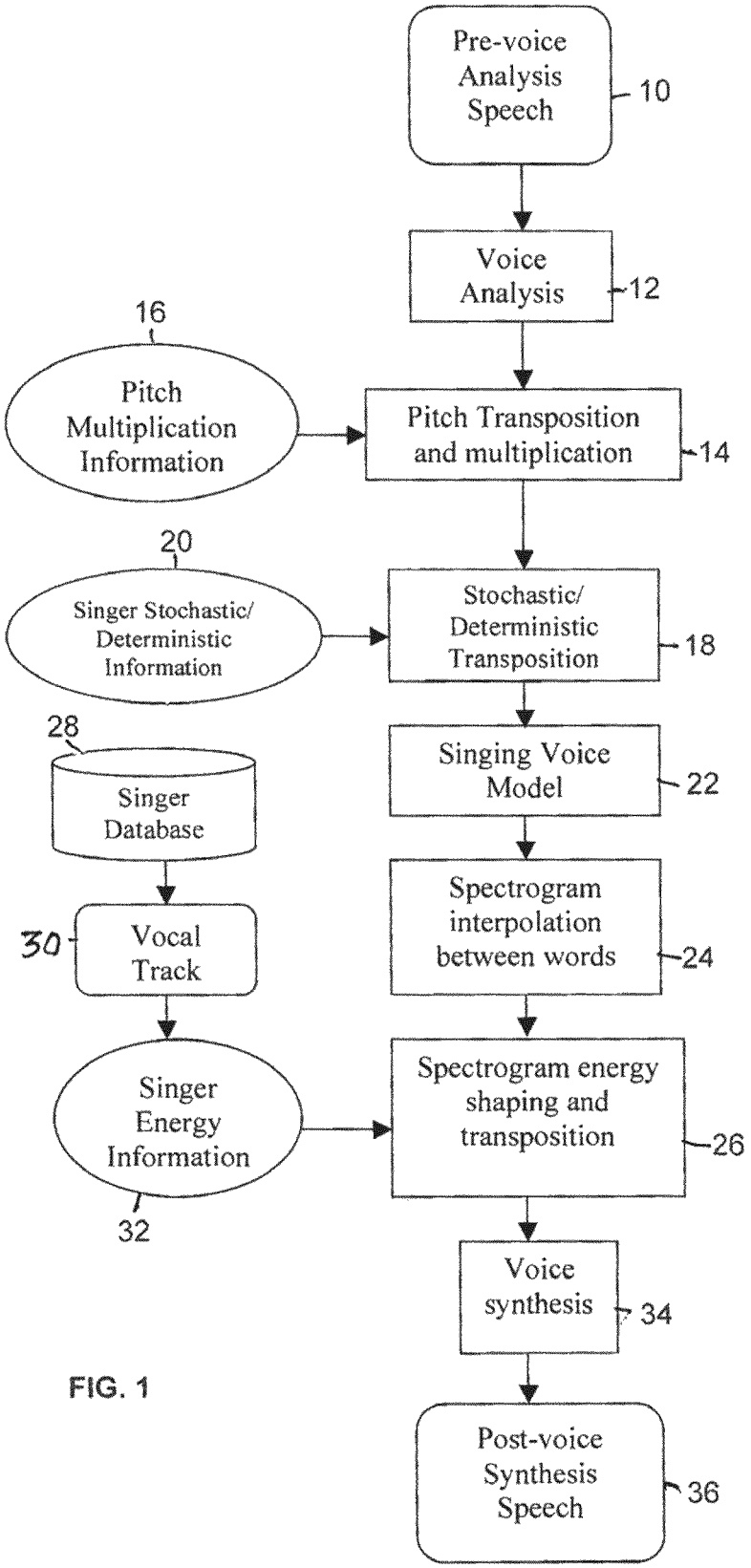
FIG. 1 is a block diagram representation of the method of the present invention.

Referring now to the drawings, preferred embodiments of the method and apparatus of the present invention will now be described in detail. Referring initially to FIG. 1, shown is a functional block diagram of the method converting single spoken word triphones of one speaker into a singing voice sung in the manner of a target singer and the triphone database according to a first embodiment of the invention.

The embodiment can be realized by a personal computer, and each of the functions of the block diagram can be executed by CPU, RAM and ROM in the personal computer. The method can also be realized by a DSP and a logic circuit. As shown in FIG. 1 the program is initialized and starts with a pre-voice analysis speech is conducted in block or step 10, which feeds to a step 12 for voice analysis. Pitch transposition and multiplication take place in step 14 with input from pitch multiplication parameter information provided in step 16. Stochastic/deterministic transposition occurs in step 18 with singer stochastic/deterministic parameter information provided by step 20. A singing voice model is created in step 22 and passed to spectrogram interpolation between words in step 24. Spectrogram energy shaping and transposition occurs in step 26, which receives the output of singer energy parameter information from step 32 obtained from singer database 28 and vocal track 30. The program moves to step 34 for voice synthesis and then to step 36 for post-voice synthesis speech.

Figure 2:
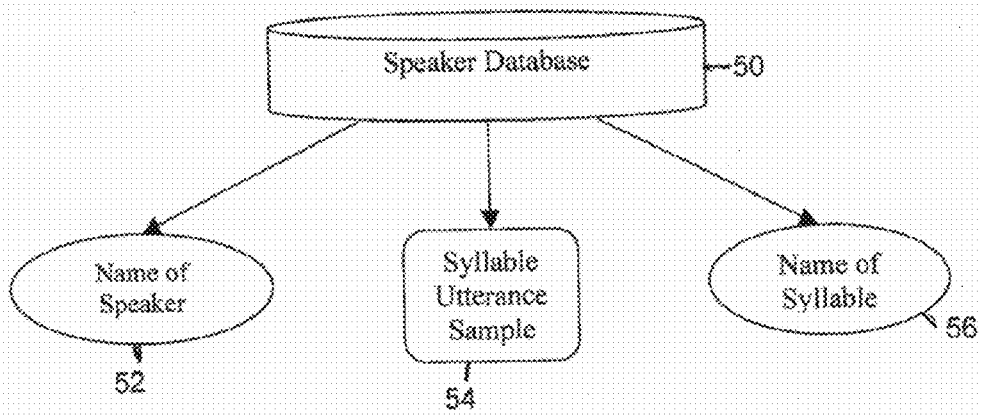
Figure 3:
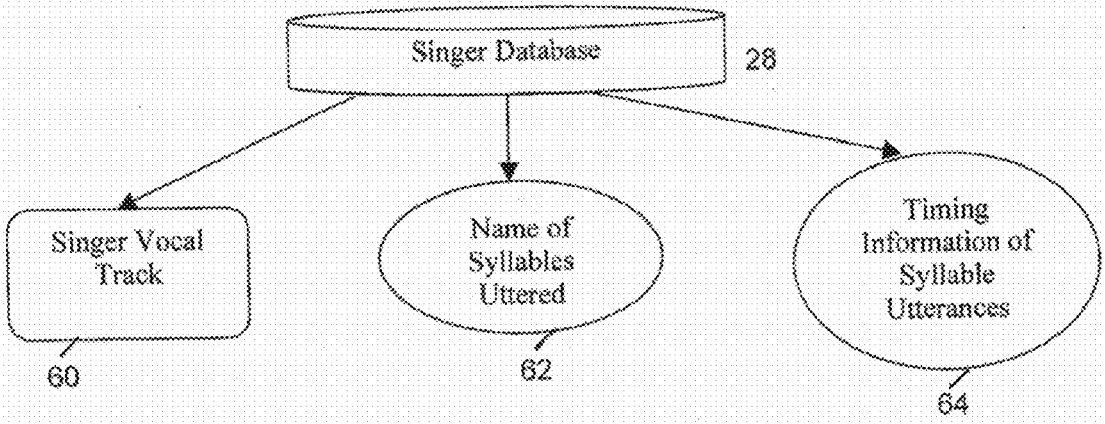
FIG. 3 is a block diagram representation of the elements in a singer database.

The triphone database 50, shown in FIG. 2, contains information on the name of a speaker 52, the utterances the person speaks 54, and the name of those utterances 56. FIG. 3 depicts the singer track database 28, which contains the vocal track of the singer 60, what triphones are sung 62 and what time those triphones occur 64. In the current embodiment, the information about the timing and identification of sung speech is processed by a human, but could be done automatically using a speech recognizer.

While the program steps above or block diagram represents in detail what each step of the singing voice synthesis is, in general there exist three major blocks: voice analysis of spoken fragments of the source speaker, voice analysis of the target singer, the re-estimation of parameters of the source speaker to match the target speaker, and the re-synthesis of the source model to make a singing voice. The voice analysis and synthesis are already well-described by prior art, but the re-estimation of parameters, especially in a singing voice domain, is the novel and non-obvious concept.

The first major non-obvious component of the model is what to store on the speech database. One could store entire utterances of speech meant to be transformed into music of the target singer. Here, alignment is done by a speech recognizer in forced alignment mode. In this mode, the speech recognizer has a transcript of what utterance is said, and forced alignment mode is used to timestamp each section of the spoken speech signal. In the current embodiment, context-independent triphones are stored in the database, so they can be reused over multiple utterances. A triphone is a series of three phones together (such as "mas"). The user is queried to utter a triphone when one is encountered in the transcript for which the database does not have that particular triphone.

Then, the fragment or fragments of speech from the source speaker and the utterance of the target singer is sent to a voice analysis system. A voice analysis system is merely a low-order parameterization of speech at a particular time step. In the current embodiment, we use the source-filter model, in particular the linear prediction coefficient (LPC) analysis. In this analysis, the voice is broken into two separate components, the impulsive excitation signal (if represented in the frequency domain instead of the time domain, this is called the pitch signal), and the filter signal. The filter and the pitch signal are re-estimated every time step (which is generally between 1-25 ms).

Figure 4:
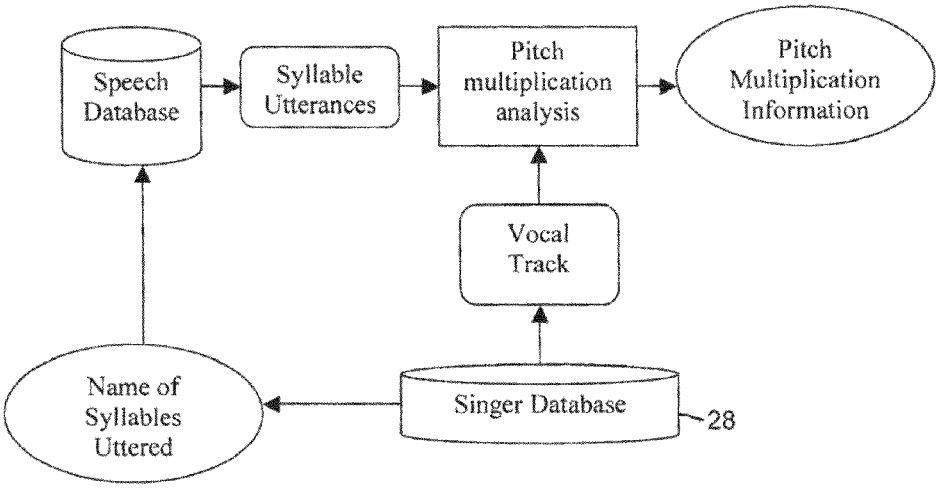
FIG. 4 is the block diagram representation of the overview of the pitch multiplication analysis technique.
Figure 5:
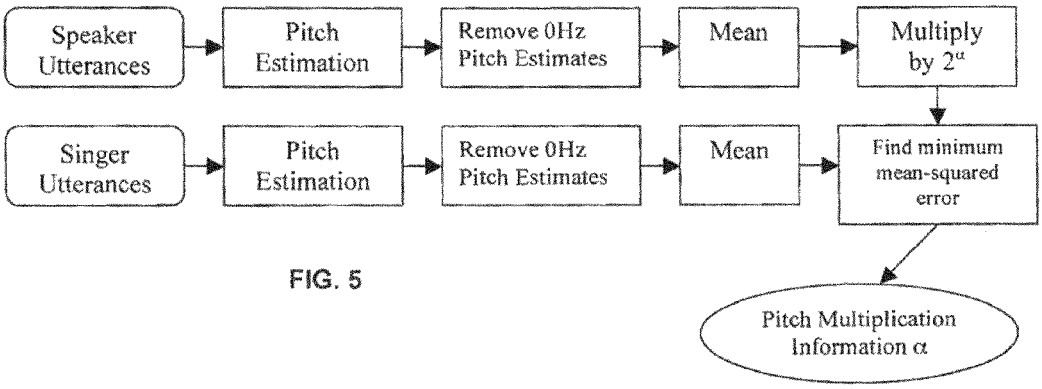
FIG. 5 and FIG. 6 are block diagrams of steps in pitch multiplication analysis for tonal and non-tonal music, respectively.

The first section of non-prior and non-obvious art is the pitch analysis and transposition algorithm. FIG. 4 is a program or block diagram representation of the pitch multiplication analysis. For every triphone uttered by the singer, obtained from the information in the singer database, a speech sample of the triphone uttered is accessed from both the singer database 28 and speech database 50. Pitch estimates are obtained for both the sung and spoken triphones through LPC analysis by an autocorrelation method, although other methods such as spectral estimation, wavelet-estimation or a combination thereof can be used for pitch estimation (see description of related art). For tonal music (such as pop, rock, etc., shown in FIG. 5), a factor $\alpha$ is obtained such that the mean-squared error between the mean of $2^{\alpha}F0_{sin\ ger}$ (where $\alpha$ is an integer) and the mean of $F0_{spea\ ker}$ weighted by the energy of the signal, is at a minimum. In mathematical terms, we are trying to find:

$$\mathrm{argmin}_{\alpha} 2^{\alpha} F0_{sin\ ger} - \mathrm{mean}(eF0_{spea\ ker})$$

where $eF0_{spea\ ker}$ is the pitch of the speaker weighted by the energy of the signal.

Figure 6:
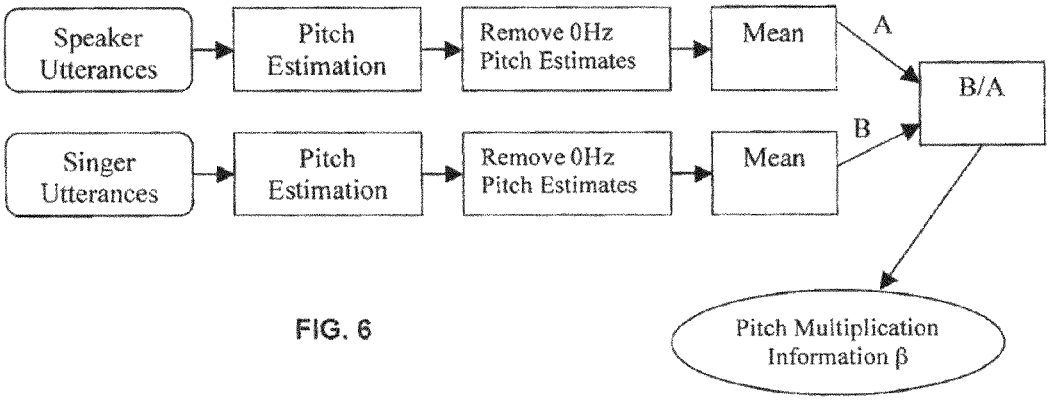

For non-tonal music (such as certain types of hip-hop, shown in FIG. 6) a factor $\beta$ is calculated such that the sum of the mean-squared error between $\beta F0_{sin\ ger}$ (where beta is a real number) and $F0_{spea\ ker}$ is at a minimum. While mean-squared error is used as the error metric as is used in the current embodiment, other metrics such as absolute value error can be used.

Figure 7:
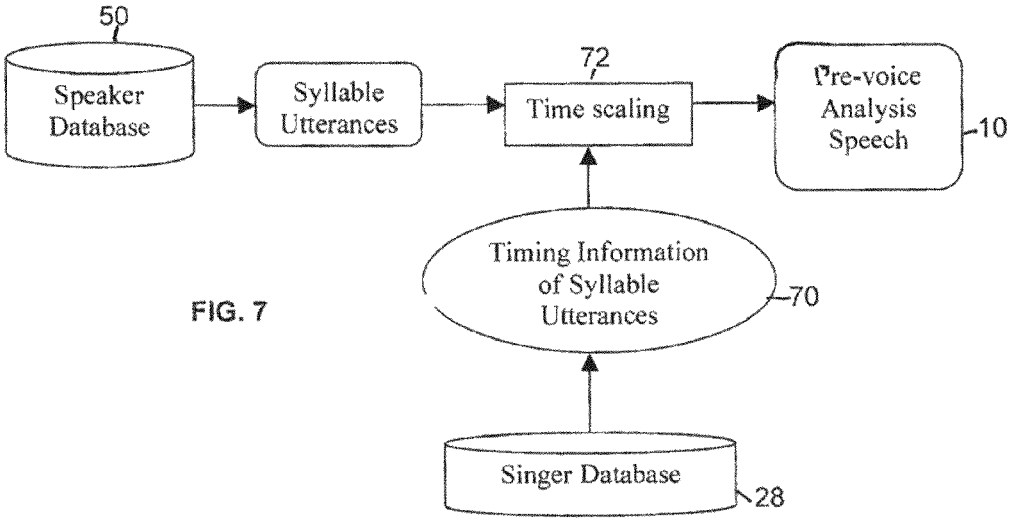
FIG. 7 is a block diagram overview of the time-scaling technique.

According to FIG. 7 of the invention, information on the occurrence of triphones is accessed from the singer database 28 and a spoken utterance of those triphones is accessed from the triphone database. For each triphone, in step 70 the timing information of the sung triphone and the spoken utterance is passed to the time-scaling algorithm in step 72. The length of the spoken utterance is obtained from the length of the signal given and the length of the sung triphone is given by the timing information. The spoken utterance of the signal is scaled such that the length of the outputted spoken utterance is the same length as the triphone. There are a number of algorithms that perform this time-scaling, such as time-domain harmonic scaling or phase vocoder (see prior art for references). In the current embodiment of the algorithm, we use the pitch-synchronous overlap and add (PSOLA) method to match the timing information, but other methods can be used. The output is received in block 10.

Figure 8:
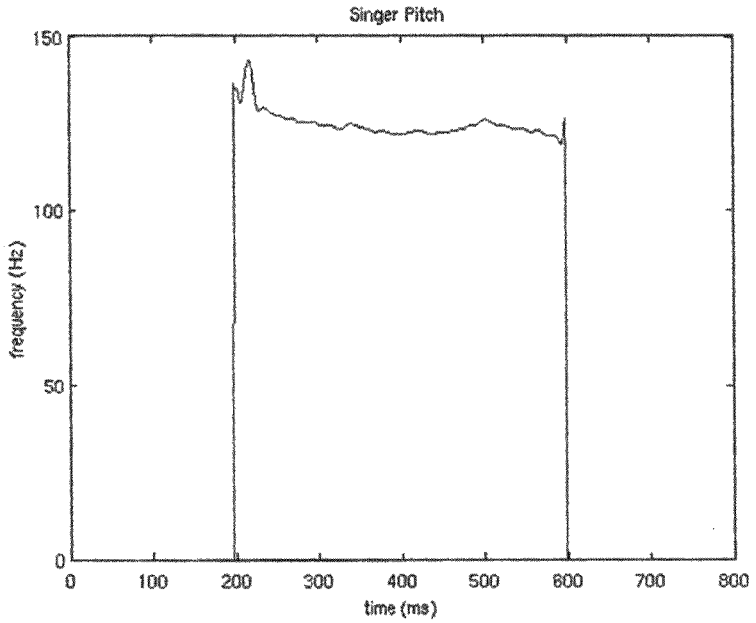
FIG. 8 is an overview of the pitch transposition technique.
Figure 8:
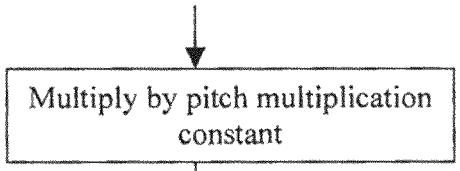
Figure 8:
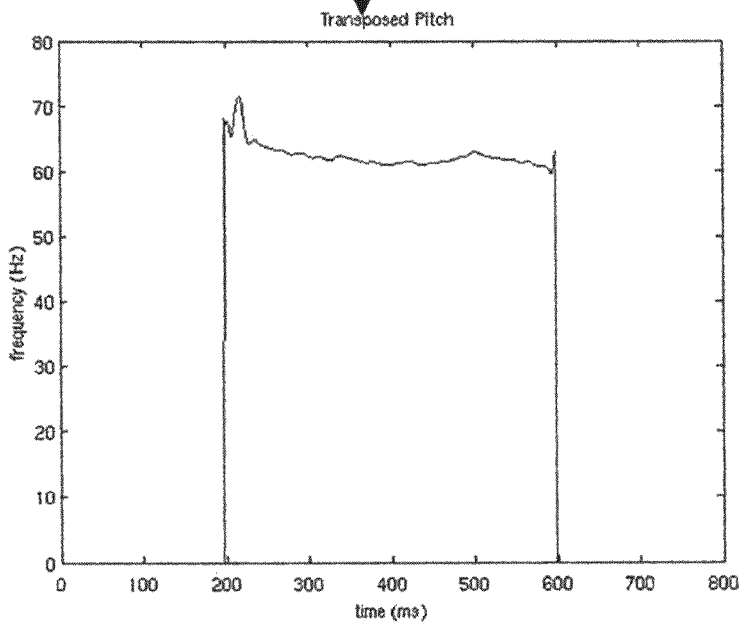

From the timing information of triphones uttered in the speech database, continuous blocks of singing are obtained and time-scaled versions of the spoken speech are accessed and analyzed through the steps of a speech analysis method decomposing speech as an excitation signal, a filter and information on deterministic and stochastic components (such as LPC, SMS). According to FIG. 8, the pitch of the singer shown in FIG. 8*a* in deterministic sections is transposed to the speaker's voice and multiplied by (pitch multiplication constant) a factor of $2^{\alpha}$ for tonal music or $\beta$ for non-tonal music. If an accurate assessment of phoneme sections of both the singer and speaker can be made, the changed pitch estimate of the singer is matched on a phoneme-by-phoneme basis; otherwise the pitch estimate is simply transposed to the speaker. Deterministic and stochastic sections of speech are transposed from the singer to the speaker, either on a phoneme-by-phoneme basis or without and shown in FIG. 8*b*.

A singing voice model may be added to change characteristics of speech into singing. This includes, but is not limited to, phoneme segments of the spoken voice to match the singer's voice, removing phonemes not found in singing, and adding a formant in the 2000-3000 Hz region and linearizing formants in voiced speech.

Figure 9:
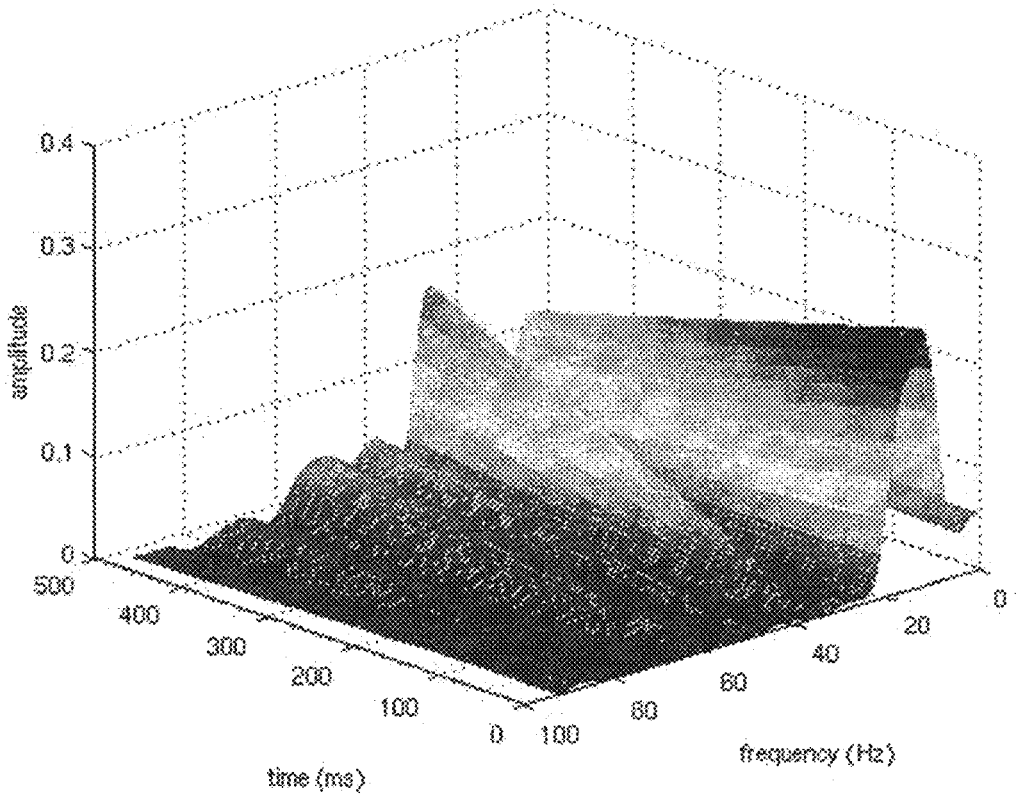
FIG. 9 is a three-dimensional plot of an example of linear interpolation between two words.

From the timing information of the triphones uttered by the singer, boundaries between triphones of the analyzed spoken speech are determined. The Fourier transform of the filter at the time of the end of a signal minus a user defined fade constant (in ms) of a preceding triphone and the Fourier transform of filter at the time of the beginning plus a user defined fade constant of a proceeding triphone are calculated. As is shown in FIG. 9, the filters of sections at times between the two boundary points are recalculated in such a manner that the amplitude of the filter at a particular frequency is a linear function between point of the preceding filter and the proceeding filter.

The next section is matching the transitions between boundaries between triphones. From the filter coefficients of the LPC analysis, the coefficients are obtained from the 90% point from the end of the beginning triphone and the 10% point from the beginning of the end triphone and a filter shape is taken by transforming the coefficients in the frequency domain. Here, we have $F_{beg}(\omega)$ and $F_{end}(\omega)$. We need to re-estimate $F_t(\omega)$ where the t subindex is the time of the filter, indexed by t. t must be between the time index $t_{beg}$ and $t_{end}$. $F_t(\omega)$ is calculated linearly as follows.

$$F_t(\omega)=\alpha F_{beg}(\omega)+(1-\alpha)F_{end}(\omega)$$

where $$\alpha = \frac{t_{end} - t}{t_{end} - t_{beg}}$$

The final piece of the algorithm is the energy-shaping component of the algorithm, to match the amplitude shape of the source speaker to the target. For each time step in the LPC analysis, the filter coefficients $f_{sin\ ger}(k)$ and $f_{source}(k)$ are transformed to the frequency domain via Fourier transform, giving $F_{sin\ ger}(\omega)$ and $F_{source}(\omega)$. Then, a scaling constant A is calculated as follows:

$$A = \frac{\int F_{singer}(\omega)d\omega}{\int F_{source}(\omega)d\omega}$$

Then, the new filter coefficients $f_{source}(k)$ are scaled by a factor of A for final analysis.

Figure 10:
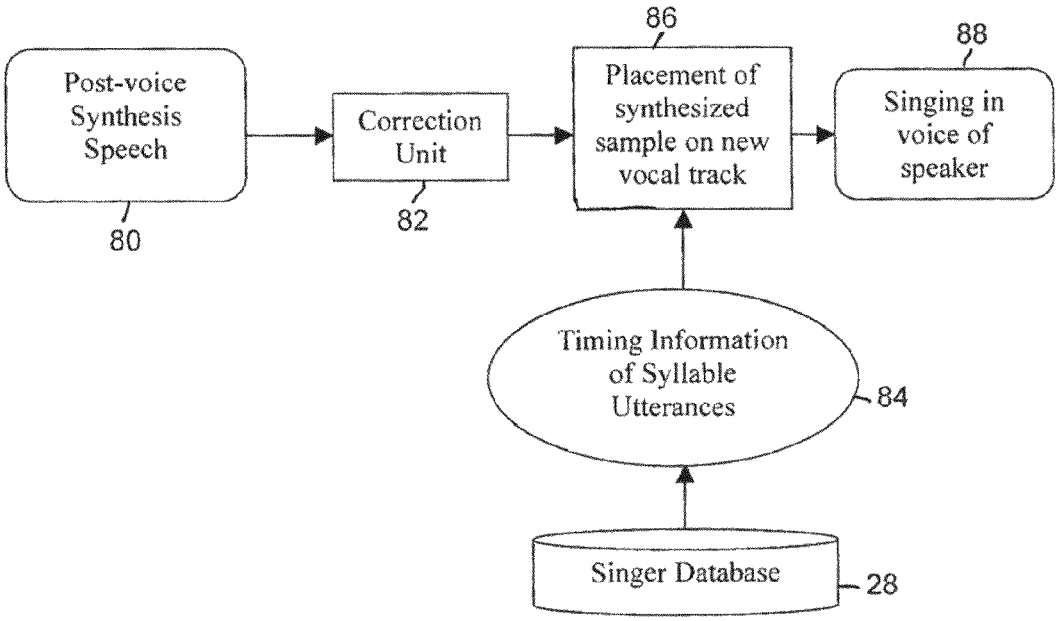
FIG. 10 is a block diagram representing post voice-synthesis steps.

As shown in FIG. 10, a singing voice sample can be synthesized from these variables and subjected to a post voice synthesis analysis 80 by means of a correction unit 82 added to reduce any artifacts from the source-filter analysis. With the timing information 84 of the triphones uttered in the singer database 28, the resultant speech sample after voice synthesis 86 is then placed in a signal timed in such a manner that the sung voice and the newly formed sample occur at the exact same point in the song. The resulting track 88 will be singing in a speaker's voice in the manner of a target singer. Thus the invention achieves the effect of modifying a speaker's voice to sound as if singing in the same manner as a singer.

Novel features of the invention include, but are not limited to, the pitch adaptation of a singer's voice to a speaker's, breaking down pitch transpositions on a phoneme-by-phoneme basis, determining the multiplication factor by which to multiply the singer's voice to transpose to a speaker's voice, and a singing voice model that changes characteristics of spoken language into sung words.

Figure 11:
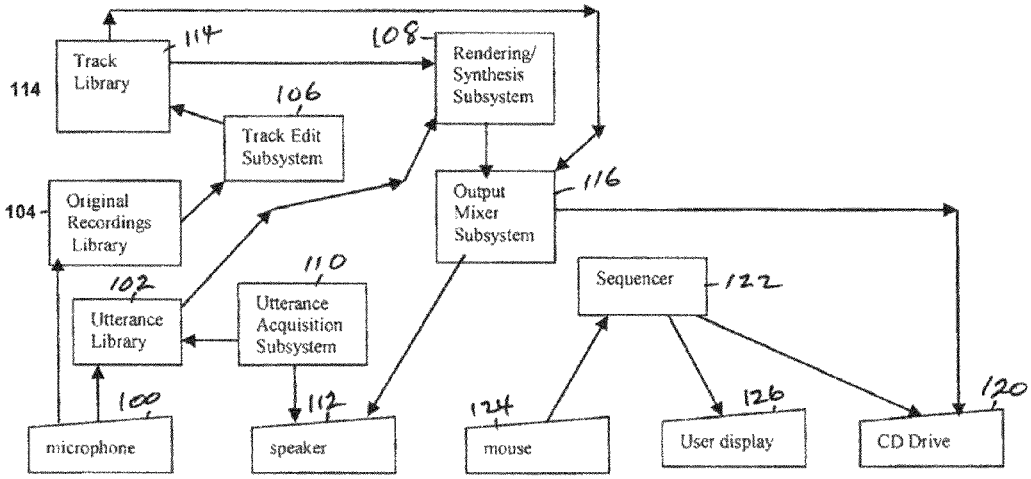
FIG. 11 is another version of an overall block diagram view of the method and apparatus of the present invention.

A further embodiment of the present invention is shown in FIGS. 11 to 16. FIG. 11 shows an overview of the method and apparatus illustrating the overall function of the system. Although not all subsystems are typically implemented on common hardware, they could be. Details of the processing and transformations are shown in the individual subsystem diagrams described in the following.

The example apparatus (machine) of the invention is implemented using a standard PC (personal computer), with a sound card that includes the ADC and the DAC required and using a stored-program method to perform the sequencing of the steps needed for the machine to perform the intended processing. These steps include transferring sequences of sounds into internal storage, processing those stored sounds to achieve the intended effect, and replaying stored processed sounds for the user's appreciation. The example machine also includes a standard CD/ROM drive to read in library files and to produce CD recordings of the processed user results.

A number of processes are carried out by to prepare the machine for use, and it is advantageous to have performed many of these steps in advance of preparing a machine programming package which prepares the machine to perform its intended use. Preparing each instance machine can be accomplished by simply copying the entire track library record from a master copy onto the manufactured or commercial unit. The following paragraphs describe steps and processes carried out by in advance of use. The order of steps can be varied as appropriate.

As shown in the block diagram of FIG. 11 a microphone 100 is coupled to an utterance library 102 coupled to a track edit subsystem 106 and an original recordings library 104 coupled to rendering/synthesis subsystem 108, which in turn is coupled to output mixer subsystem 116. An utterance acquisition subsystem 110 is coupled to utterance library 102 and speaker 112. Track edit subsystem 106 is coupled to track library 114, which is coupled to rendering/synthesis subsystem 108 and to output mixer subsystem 116, which is coupled to renderings/synthesis subsystem 108, speaker 112 and to CD drive 120. Sequencer 122 is coupled to mouse 124, user display 126 and CD drive 120.

As shown in FIG. 11, the user prepares the machine by speaking the sounds needed to make up the different parts of the words of the song lyrics. Sounds which they have already used for prior songs need not be respoken, as the system includes the ability to reuse sounds from other songs the user has produced. The machine includes an analog-to-digital converter (ADC) configured to produce an internal format as detailed below. The system configures and operates the ADC to record samples of the user speaking the sounds needed to make up the lyrics of a song, after which the processing phase causes their voice to sound as if it were singing the song with the same pitch and timing as the original artist. The synthetic vocal track is then mixed with the instrumental recording to produce a track which sounds as if the user has replaced the original artist. The system includes a digital-to-analog converter (DAC) which can replay the final mixed output as audio for the user to enjoy. The system retains the final mixed track for later replay, in a form readily converted to media such as that used for an audio Compact Disc (CD).

Figure 12:
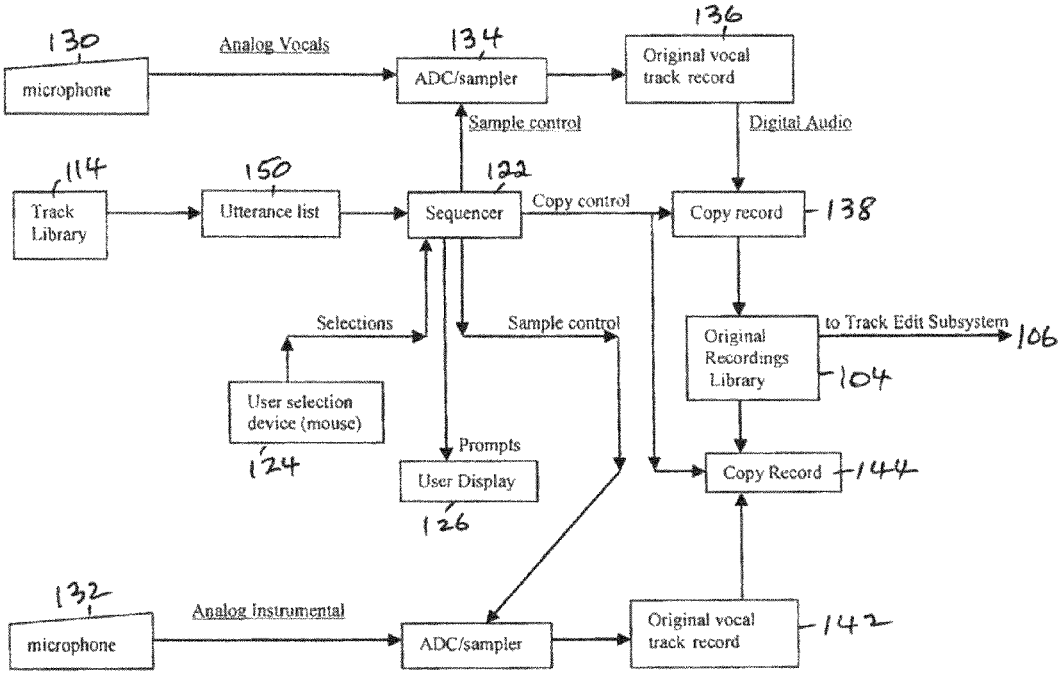
FIG. 12 is a block diagram of an original recordings library acquisition subsystem of the method and apparatus of the present invention.

Shown in FIG. 12 is the original recordings library acquisition subsystem. The system uses original artist performances as its first input. Input recordings of these performances are created using a multi-track digital recording system in PCM16 stereo format, with the voice and instrumentation recorded on separate tracks. The system coordinates the acquisition of the recordings, and adds them to the Original Recordings Library. The original recordings library is then used to produce the track library by means of the track edit subsystem.

This original recordings library acquisition subsystem consists of a microphone 130 for analog vocals and a microphone 132 for analog instrumental. Microphone 130 is coupled to an ADC sampler 134, which is coupled to an original vocal track record 136 from which digital audio is coupled to copy record 138. Microphone 132 is coupled to an ADC sampler 140, which in turn is coupled to original vocal track record 142, in turn coupled to copy record 144. Track library 114 is coupled to utterance list 150, which in turn is coupled to sequencer 122. Original recordings library 104 is coupled to both record copy 138 and 144 and has an output to the track edit subsystem 106. User selection device or mouse 124 and user display 126 are coupled to sequencer 122, which provides sample control to ADC sampler 140.

Figure 13:
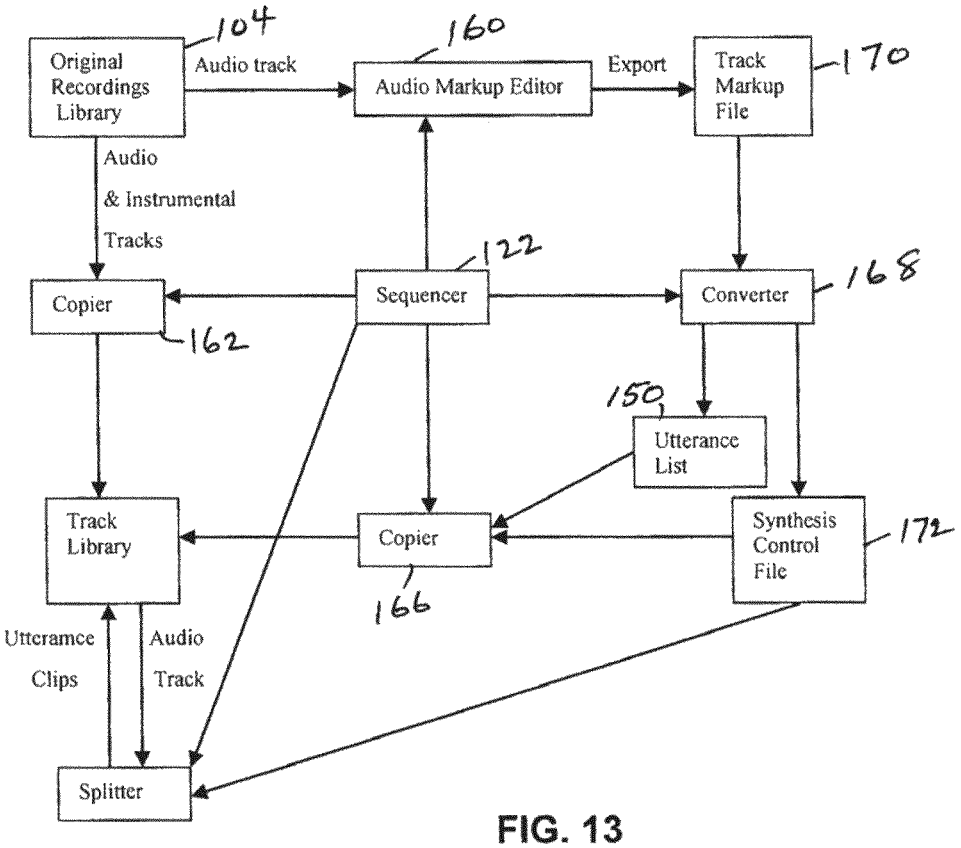
FIG. 13 is a block diagram of a track edit subsystem of the method and apparatus of the present invention.

FIG. 13 shows the track edit subsystem. The Track Edit Subsystem uses a copy of the Original Recordings Library as its inputs. The outputs of the Track Edit Subsystem are stored in the Track Library, including an Utterance list, a Synthesis Control File, and original artist utterance sample digital sound recording clips, which the Track Edit Subsystem selects as being representative of what the end user will have to say in order to record each utterance. For each track in the desired Track Library, the Track Edit Subsystem produces the required output files which the user needs in the Synthesis/Rendering Subsystem as one of the process inputs.

The purpose of the Track Edit Subsystem is to produce the Track Library in the form needed by the Utterance Acquisition Subsystem and the Rendering/Synthesis Subsystem.

As shown, FIG. 13 consists of original recordings library 104 coupled to audio markup editor 160 for an audio track and is coupled to copier 162 for audio and instrumental tracks. Copier 162 is coupled to sequencer 122 and track library 114. A splitter 164 is coupled to track library for utterance clips and audio track. Sequencer 122 is coupled to a second copier 166 and to a converter 168. Audio markup editor 160 is coupled to track markup file 170, which in turn is coupled to converter 168. Converter 168 is coupled to utterance list 150, which in turn is coupled to copier 166. Converter 168 is also coupled to synthesis control file 172, which in turn is coupled to copier 166 and splitter 164.

One of the primary output files produced by the Track Edit Subsystem identifies the start and end of each utterance in a vocal track. This is currently done by using an audio editor (Audacity) to mark up the track with annotations, then exporting the annotations with their associated timing to a data file. An appropriately programmed speech recognition system could replace this manual step in future implementations. The data file is then translated from the Audacity export format into a list of utterance names, start and end sample numbers, and silence times also with start and end sample numbers, used as a control file by the synthesis step. The sample numbers are the PCM16 ADC samples at standard 44.1 KHz frequency, numbered from the first sample in the track. Automated voice recognition could be used to make this part of the process less manually laborious. A header is added to the synthesis control file with information about the length of the recording and what may be a good octave shift to use. The octave shift indicator can be manually adjusted later to improve synthesis results. The octave shift value currently implemented by changing the control file header could also be a candidate for automated voice recognition analysis processing to determine the appropriate octave shift value. Once the synthesis control file is ready, a splitter is run which extracts each utterance from the original recording and stores it for later playback. A data file which lists the names of the utterances used is also produced, with duplicates removed. All these steps are carried out by the manufacturer to prepare the machine for each recording in the system's library. To add a new track, the above steps are followed and a record is added to the track library main database indicating what the track name is. Each machine is prepared with a track library (collection of song tracks the machine can process) by the manufacturer before the machine is used. A stored version of the track library is copied to each machine in order to prepare it before use. A means is provided by the manufacturer to add new tracks to each machine's track library as desired by the user and subject to availability of the desired tracks from the manufacturer—the manufacturer must prepare any available tracks as described above.

Each of the subsystems described so far is typically created and processed by the manufacturer on their facilities. Each of the subsystems may be implemented using separate hardware or on integrated platforms as convenient for the needs of the manufacturers and production facilities in use. In the current implementation, the Original Recordings Acquisition Subsystem is configured separately from the other subsystems, which would be the typical configuration since this role can be filled by some off-the-shelf multi-channel digital recording devices. In this case, CD-ROM or electronic communications means such as FTP or e-mail are used to transfer the Original Recordings Library to the Track Edit Subsystem for further processing.

In the example implementation, the Track Edit Subsystem is implemented on common hardware with the subsystems that the end user interacts with, but typically the Track Library would be provided in its "released" condition such that the user software configuration would only require the Track Library as provided in order to perform all of the desired system functions. This allows a more compact configuration for the final user equipment, such as might be accomplished using an advanced cell phone or other small hand-held device.

Once the Track Library has been fully prepared, it can be copied to a CD/ROM device and installed on other equipment as needed.

Figure 14:
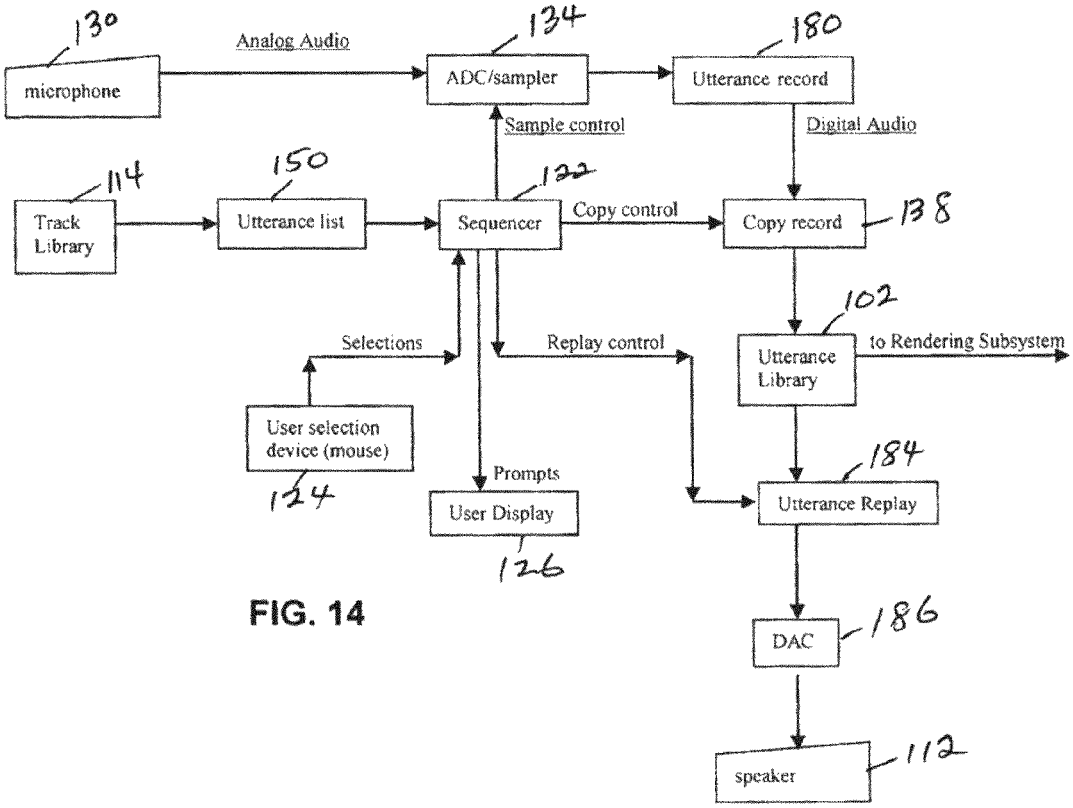
FIG. 14 is a block diagram of an utterance library acquisition subsystem of the method and apparatus of the present invention.

FIG. 14 shows in block diagram the utterance library acquisition subsystem; the input is spoken voice and the output is the utterance library. The system provides a means to prompt the user during the process of using the machine to produce a track output. The system prompts the user to utter sounds which are stored by the system in utterance recording files. Each recording file is comprised of the sequence of ADC samples acquired by the system during the time that the user is speaking the sound.

As shown in FIG. 14, the subsystem consists of microphone 130 coupled to ADC sampler 134, which in turn is coupled to utterance record 180 output to copy record 138 that is coupled to utterance library 102. Track library 114 is coupled to utterance list coupled to sequencer 122. User selection device (mouse) 124 and user display 126 are coupled to sequencer 122. Utterance library 102 is coupled to utterance replay 184, in turn coupled to DAC 186 and coupled in turn to speaker 112. The output of the utterance library is to the rendering subsystem.

To use the system, the user selects the track in the track library which they wish to produce. The list of utterances needed for the track is displayed by the system, along with indicators that show which of the utterances have already been recorded, either in the current user session or in prior sessions relating to this track or any other the user has worked with. The user selects an utterance they have not recorded yet or which they wish to re-record, and speaks the utterance into the system's recording microphone. The recording of the utterance is displayed in graphical form as a waveform plot, and the user can select start and end times to trim the recording so that it contains only the sounds of the desired utterance. The user can replay the trimmed recording and save it when they are satisfied. A means is provided to replay the same utterance from the original artist vocal track for comparison's sake.

Figure 15:
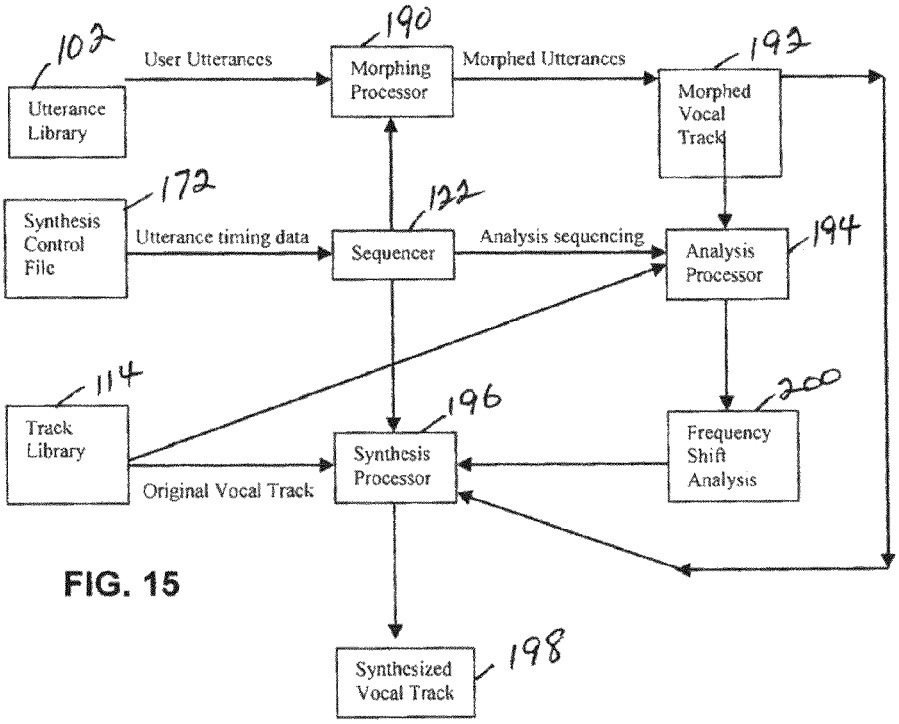
FIG. 15 is a block diagram of a rendering/synthesis subsystem of the method and apparatus of the present invention.

FIG. 15 shows in block diagram the rendering/synthesis subsystem which consists of utterance library 102 coupled to morphing processor 190 coupled in turn to morphed vocal track 192. Synthesis control file 172 is coupled to sequence 122 in turn coupled to morphing processor 190, analysis processor 194 and synthesis processor 196, which is coupled to synthesis vocal track 198. Morphed vocal track 192 is coupled to analysis processor 194 and to synthesis processor 196. Analysis processor is coupled to frequency shift analysis 200. Track library 114 is coupled to synthesis processor 196 and to analysis processor 194.

Once the user has recorded all the required utterances, the rendering/synthesis process is initiated. In this process, the synthesis control file is read in sequence, and for each silence or utterance, the inputs are used to produce an output sound for that silence or utterance. Each silence indicated by the control file is added to the output file as straight-line successive samples at the median-value output. This method works well for typical silence lengths, but is improved by smoothing the edges into the surrounding signal. For each utterance indicated by the control file, the spoken recording of the utterance is retrieved and processed to produce a "singing" version of it which has been stretched or shortened to match the length of the original artist vocal utterance, and shifted in tone to also match the original artist's tone, but retaining the character of the user's voice so that the singing voice sounds like the user's voice.

The stretching/shrinking transformation is referred to as "morphing". If the recording from the Utterance Library is shorter than the length indicated in the Synthesis Control File, it must be lengthened (stretched). If the recording is longer than the indicated time, it must be shortened (shrunk). The example machine uses the SOLAFS voice record morphing technique to transform each utterance indicated by the control file from the time duration as originally spoken to the time duration of that instance of the utterance in the original recording.

A Morphed Vocal Track is assembled by inserting all the silences and each utterance in turn as indicated in the Synthesis Control File, morphed to the length indicated in the control file. The Morphed Vocal Track is in the user's spoken voice, but the timing exactly matches that of the original artist's vocal track.

This invention next uses an Analysis/Synthesis process to transform the Morphed Vocal Track from spoken voice into sung voice, where the each section of the Morphed Vocal Track is matched to the equivalent section of the Original Artist Vocal Track, and the difference in frequency is analyzed. Then the Morphed Vocal Track is transformed in frequency to match the Original Artist Vocal Track tones by means of a frequency shifting technique. The resulting synthesized output is a Rendered Vocal Track which sounds like the user's voice singing the vocal track the with the same tone and timing as the Original Artist Vocal Track.

The example machine uses the STRAIGHT algorithm to transform each of the user's stored spoken utterances as indicated by the control file into new stored sung utterance that sounds like the user's voice but otherwise corresponds to the original artist in pitch, intonation, and rhythm.

The sequence of synthesized utterances and silence output sections is then assembled in the order indicated by the synthesis control file into a single vocal output sequence. This results in a stored record that matches the original artist vocal track recording but apparently sung in the user's voice.

Figure 16:
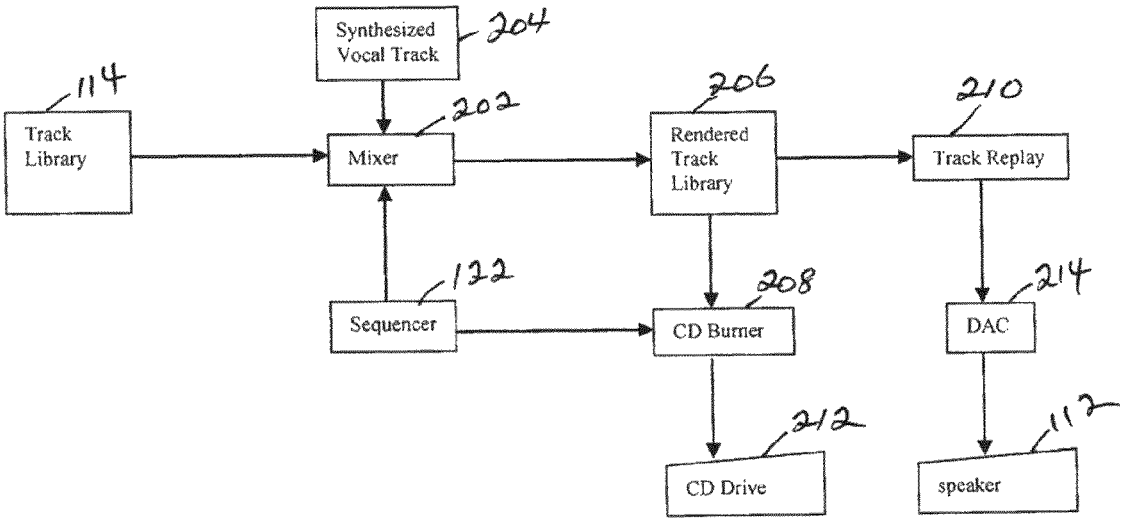
FIG. 16 is a block diagram of an output mixer subsystem of the method and apparatus of the present invention.

FIG. 16 shows in block diagram the Output Mixer Subsystem, which consists of the track library 114 coupled to mixer 202. Synthesized vocal track 204 is coupled to mixer 202 as well as sequencer 122. The mixer is coupled to rendered track library 206, which in turn is coupled to CD burner 208 and to track replay 210. Burner 208 is coupled to CD drive 212. Track replay is coupled via DAC 214 to speaker 112.

The synthesized vocal track is then mixed with the filtered original instrumental track to produce a resulting output which sounds as if the user is performing the song, with the same tone and timing as the original artist but with the user's voice.

The mixing method used to combine the synthesized vocal track with the original filtered instrumental track is PCM16 addition. The example machine does not implement a more advanced mixing method and does not exclude it. The PCM16 addition mechanism was selected for simplicity of implementation and was found to provide very good performance in active use.

The resulting final mixed version of the track is stored internally for replay as desired by the user.

The example machine also allows the user to select any track they have previously produced and replay it through the audio DAC or to convert it to recorded audio CD format for later use. This allows repeated replay of the simulated performance the system is designed to produce.

In summary the present invention enables a user to create a machine to transform spoken speech samples acquired from the user into musical renditions of example or selected original artist tracks that sound like the user is singing the original track's singing part in place of the original recording's actual singer.

Although the invention herein has been described in specific embodiments nevertheless changes and modifications are possible that do not depart from the scope and spirit of the invention. Such changes and modifications as will be apparent to those of skill in this art, which do not depart from the inventive teaching hereof are deem to fall within the purview of the claims.

What is claimed is:

1. Method for producing a record of a person's voice comprising the steps of:

a. storing a recording of an artist singing a song;

b. storing a selected sequences of sounds of a person correlated with the words being sung in the song, wherein the selected stored sounds are spoken triphones:

c. processing the selected stored sounds so that the person's voice sounds as if the person were singing the song with the same pitch and timing as the artist singing the song as stored in step a;

d. combining the processed selected stored sounds with the instrumental track of the song; and e. storing the combined processed selected stored sounds with the instrumental track of the song.

2. The method of claim 1 comprising the further step of replaying the combined processed selected stored sounds with the instrumental track of the song for the users appreciation.

3. The method of claim 1 wherein a tonal pitch transposition algorithm is employed to convert spoken triphones to a singing voice.

4. The method of claim 1 wherein a non-tonal pitch transposition algorithm is employed to convert spoken triphones to a singing voice.

5. The method of claim 1 wherein a filter coefficient estimation algorithm in a source-filter model is employed to enable for smooth transitions between the end of one triphone to the beginning of the next triphone.

6. Method for producing a record of a person's voice comprising the steps of:

a. recording samples of a user speaking the sounds needed to make up the lyrics of a song sung by an artist, wherein the recorded sounds are spoken triphones;

b. processing to cause the user's voice to sound to produce a synthetic vocal track as if the user were singing the song with the same pitch and timing as the artist;

c. mixing the synthetic vocal track with an instrumental recording of the song as sung by the artist to produce a combined track that sounds as if the user has replaced the original artist; and d. storing the mixed combined track.

7. The method of claim 6 wherein a tonal pitch transposition algorithm is employed to convert spoken triphones to a singing voice.

8. The method of claim 6 wherein a non-tonal pitch transposition algorithm is employed to convert spoken triphones to a singing voice.

9. The method of claim 6 wherein a filter coefficient estimation algorithm in a source-filter model is employed to enable for smooth transitions between the end of one triphone to the beginning of the next triphone.

10. The method of claim 6 including the further step of replaying the combined track of the song for the user's appreciation.

11. Apparatus for producing a record of a person's voice comprising:

a. means for storing a recording of an artist singing a song;

b. means for storing a selected sequences of sounds of a person correlated with the words being sung in the song, wherein the selected stored sounds are spoken triphones;

c. means for processing the selected stored sounds so that the person's voice sounds as if the person were singing the song with the same pitch and timing as the artist singing the song as stored in step a;

d. means for combining the processed selected stored sounds with the instrumental track of the song; and e. means for storing the combined processed selected stored sounds with the instrumental track of the song.

12. The apparatus of claim 11 comprising the further step of replaying the combined processed selected stored sounds with the instrumental track of the song for the user's appreciation.

13. The apparatus of claim 11 including means comprising a tonal pitch transposition algorithm for converting spoken triphones to a singing voice.

14. The apparatus of claim 11 including means comprising a non-tonal pitch transposition algorithm for converting spoken triphones to a singing voice.

15. The apparatus of claim 11 including means comprising a filter coefficient estimation algorithm in a source-filter model for enabling for smooth transitions between the end of one triphone to the beginning of the next triphone.

16. A non-transitory computer-readable medium including program instructions for storing a recording of an artist singing a song; storing a selected sequences of sounds of a person correlated with the words being sung in the song, wherein the selected stored sounds are spoken triphones; processing the selected stored sounds so that the person's voice sounds as if the person were singing the song with the same pitch and timing as the artist singing the song as stored; combining the processed selected stored sounds with the instrumental track of the song; and storing the combined processed selected stored sounds with the instrumental track of the song.

* * * * *